US008365802B2

(12) United States Patent
Zhu

(10) Patent No.: US 8,365,802 B2
(45) Date of Patent: Feb. 5, 2013

(54) DRUM DRIVING DEVICE FOR WINDOW SHADE

(76) Inventor: Xiang-Rong Zhu, Flatad-Tongnamahjardim (MO)

( * ) Notice: Subject to any disclaimer, the term of this patent is extended or adjusted under 35 U.S.C. 154(b) by 338 days.

(21) Appl. No.: 12/763,270

(22) Filed: Apr. 20, 2010

(65) Prior Publication Data

US 2011/0011543 A1 Jan. 20, 2011

(51) Int. Cl.
*E06B 9/56* (2006.01)

(52) U.S. Cl. ..... 160/298; 160/291

(58) Field of Classification Search ..... 160/291, 160/294, 298, 299, 307, 323.1, 309, 313, 160/315, 319, 322; 192/223.4
See application file for complete search history.

(56) References Cited

U.S. PATENT DOCUMENTS

| | | | | |
|---|---|---|---|---|
| 4,513,805 | A | 4/1985 | Mase | 160/299 |
| 5,375,643 | A * | 12/1994 | Rude | 160/321 |
| 5,443,109 | A * | 8/1995 | Benthin | 160/298 |
| 5,566,741 | A * | 10/1996 | Ogawara et al. | 160/297 |
| 6,158,563 | A * | 12/2000 | Welfonder et al. | 192/223.3 |
| 2004/0261958 | A1 | 12/2004 | Sugiyama et al. | 160/296 |

FOREIGN PATENT DOCUMENTS

| | | |
|---|---|---|
| CN | 2251321 | 4/1997 |
| CN | 2329751 | 7/1999 |
| CN | 2725495 | 9/2005 |
| CN | 101025073 | 8/2007 |
| CN | 101139909 | 3/2008 |
| CN | 101139910 | 3/2008 |
| CN | 101240691 | 8/2008 |
| CN | 201106396 | 8/2008 |
| CN | 201148833 | 11/2008 |
| CN | 201152137 | 11/2008 |
| CN | 101476443 | 7/2009 |
| WO | WO2006133639 | 12/2006 |
| WO | WO2009025693 | 4/2009 |

* cited by examiner

*Primary Examiner* — Katherine W Mitchell
*Assistant Examiner* — Jeremy Ramsey
(74) *Attorney, Agent, or Firm* — Alan Kamrath; Kamrath IP Lawfirm, P.A.

(57) ABSTRACT

A drum driving device for a window shade includes a housing fixed to a frame of the window shade. A cord pulley is rotatably received in the housing. A drum is rotatably mounted to a drum shaft received in the housing A single-direction clutch device is mounted between the drum and the cord pulley. The clutch device includes a chamber defined in the housing. A driving shaft is coaxially mounted to the cord pulley. A transmission shaft is mounted in the chamber. A driving spring is mounted to an inner periphery of the chamber and around the driving shaft and the transmission shaft in the chamber. The transmission shaft has an outer diameter not larger than that of the transmission shaft. The driving spring is in tight contact with the driving shaft and the inner periphery of the chamber. The transmission shaft is extended out of the chamber and connected to the drum.

6 Claims, 1 Drawing Sheet

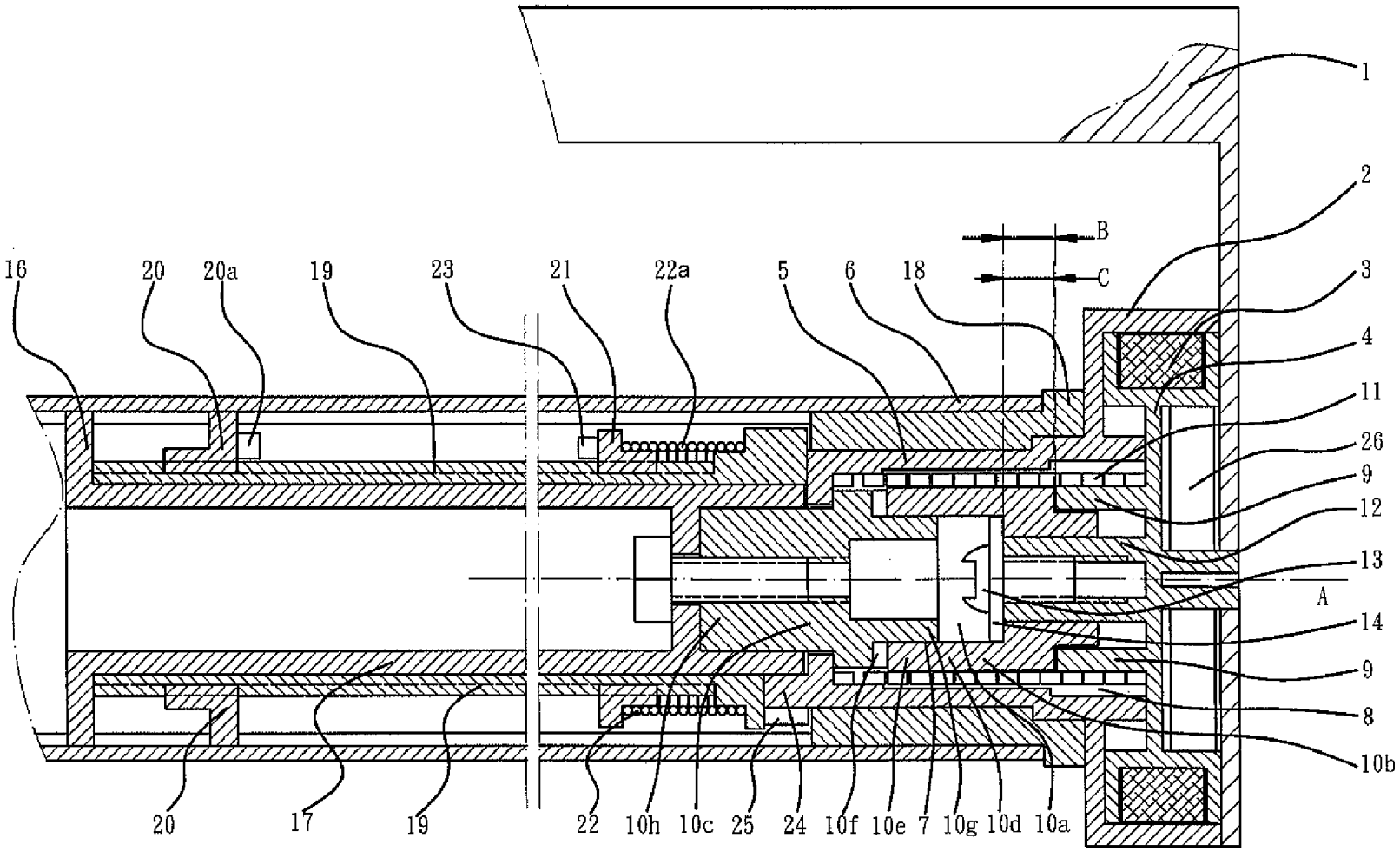
1
2
3
4
11
26
9
12
13
A
14
9
8
10b
B
C
18
6
5
22a
21
23
19
20a
20
16
10a
10d
10g
7
10e
10f
24
25
10c
10h
22
19
17
20

DRUM DRIVING DEVICE FOR WINDOW SHADE

BACKGROUND OF THE INVENTION

The present invention relates to a drum driving device for a window shade and, more particularly, to a drum driving device for a window shade that is simple in structure and reliable in operation.

A drum driving device disclosed in China Utility Model No. 200820044961.2 includes a single direction clutch device mounted between a drum and a cord pulley. The clutch device is comprised of a shaft coaxially mounted to the drum for driving the drum to rotate and a slideable rotary seat coaxial to the shaft for clutching purposes. An end face of the shaft coupled to the rotary seat includes teeth for single-direction coupling. A housing includes an axial hole coaxial to the drum. The shaft has a clutch shaft section to which an end of the rotary seat is engaged. The engaging location of the clutch shaft section and the end of the rotary seat is in the axial hole. The other end of the rotary seat is located in a socket in a side of the cord pulley and includes an inclined groove receiving a sliding block formed in the socket. In operation, when the cord pulley is rotated by pulling a pull cord, the sliding block slides along the inclined groove to push the rotary seat towards the shaft, causing engagement between the end of the rotary seat and the end face of the shaft. The shaft is rotated by the rotary seat to drive the drum to rotate. When the pull cord is released, the cord pulley rotates in a reverse direction under the action of a return spring to wind the pull cord around the cord pulley. At the same time, the slide rotates in the reverse direction together with the rotary seat and moves along the inclined groove away from the shaft to disengage the rotary seat from the shaft while under the action of a compression spring. Thus, the shaft rotates freely, allowing joint, smooth rotation of the shaft and the drum. However, friction exists between the sliding block and the inclined groove. Frequent use causes wear to the sliding block and the inclined groove. In particular, when the sliding block stops in a location in the inclined groove and then starts to move, the pressure imparted to the sliding block is relatively large. Furthermore, the static friction is larger than the sliding friction. Thus, the inclined groove is liable to wear, causing non-smooth movement of the sliding block and causing malfunction of the clutch device. Further, the clutch device is complicated and, thus, has high manufacturing costs.

Thus, a need exits for a drum driving device for a window shade that is simple in structure and reliable in operation.

BRIEF SUMMARY OF THE INVENTION

The present invention solves this need and other problems in the field of reliable operation of window shades by providing, in a preferred form, a drum driving device including a housing fixed to a frame of a window shade. A cord pulley is rotatably received in the housing and has a cord wound around the cord pulley. A drum is rotatably mounted to a drum shaft received in the housing. A single-direction clutch device is mounted between the drum and the cord pulley. The clutch device includes a chamber defined in the housing and coaxial to an axis of the housing. A driving shaft is coaxially mounted to the cord pulley. A transmission shaft is mounted in the chamber. A driving spring is mounted to an inner periphery of the chamber and around the driving shaft and the transmission shaft in the chamber. The transmission shaft has an outer diameter not larger than that of the driving shaft. The driving spring is in tight contact with the driving shaft and the inner periphery of the chamber. The transmission shaft is extended out of the chamber and connected to the drum.

In the most preferred form, the cord pulley includes a coaxial positioning axle to which the transmission shaft is mounted. A positioning ring is formed on an end face of the positioning axle. A spacing between the end face of the positioning axle and an end face of the driving shaft is slightly larger than a spacing between the end face of the driving shaft and an end face of an axial hole of the transmission shaft facing the end face of the driving shaft. The transmission shaft includes an inner transmission shaft rotatably mounted to the positioning axle. The transmission shaft further includes an outer transmission shaft coupled to the inner transmission shaft. The inner transmission shaft includes the axial hole and a transmission ring. The outer transmission shaft includes a connecting head having a groove in which an insert end of the transmission ring is engaged. The insert end is engaged in the groove. The outer transmission shaft further includes a rotary head extending out of the chamber. The rotary head is coupled to a drum driving shaft. The driving shaft has a connecting block coupled to the drum.

The present invention will become clearer in light of the following detailed description of illustrative embodiments of this invention described in connection with the drawing.

DESCRIPTION OF THE DRAWING

The illustrative embodiments may best be described by reference to the accompanying drawing where:

FIG. 1 shows a cross sectional view of a drum driving device for a window shade according to the preferred teachings of the present invention.

The FIGURE is drawn for ease of explanation of the basic teachings of the present invention only; the extensions of the FIGURE with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various FIGURES of the drawings, the same numerals designate the same or similar parts. Furthermore, when the terms "inner", "outer", "side", "end", "portion", "section", "axial", "radial", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIG. 1, a drum driving device for a window shade according to the preferred teachings of the present invention generally includes a housing 2 fixed to a frame 1 of the window shade, a cord pulley 4 rotatably received in housing 2 and having a cord 3 wound around cord pulley 4, a drum 6 rotatably mounted by a connecting member 18 to a drum shaft 5 received in housing 2, and a single-direction clutch device 7 mounted between drum 6 and cord pulley 4. A return spring 26 is mounted between cord pulley 4 and housing 2.

Clutch device 7 includes a chamber 8 defined in housing 2 and coaxial to an axis A of housing 2, a driving shaft 9 coaxially mounted to cord pulley 4, a transmission shaft 10 mounted in chamber 8, and a driving spring 11 mounted to an inner periphery of chamber 8 and around driving shaft 9 and transmission shaft 10 in chamber 8. Transmission shaft 10 has an outer diameter not larger than that of driving shaft 9. Preferably, the outer diameter of transmission shaft 10 is slightly smaller than that of driving shaft 9. Driving spring 11 is in tight contact with driving shaft 9 and the inner periphery of chamber 8. Transmission shaft 10 is extended out of chamber 8 and connected to drum 6.

In operation, when cord pulley 4 is rotated by pulling a pull cord, driving shaft 9 is driven to rotate in a direction identical to a winding direction of driving spring 11, causing contraction of driving spring 11 in a radial direction perpendicular to axis A. The inner diameter of the contracted driving spring 11 is reduced and, thus, tightly clamps around driving shaft 9 and transmission shaft 10. The outer diameter of the contracted driving spring 11 is reduced and, thus, disengaged from the inner periphery of chamber 8. Thus, driving spring 11 rotates together with driving shaft 9 and transmission shaft 10 relative to the inner periphery of chamber 8. Drum 6 is rotated by transmission shaft 10. On the other hand, when the pull cord is released, cord pulley 4 rotates in a reverse direction under the action of return spring 26 to wind the pull cord around cord pulley 4. At the same time, driving shaft 9 rotates in a direction reverse to the winding direction of driving spring 11 such that the inner diameter of driving spring 11 is increased and, thus, disengages from driving shaft 9 and transmission shaft 10 for unfolding purposes. Furthermore, the outer diameter of driving spring 11 is increased and, thus, tightly presses against the inner periphery of chamber 8. Accordingly, driving spring 11 can not drive transmission shaft 10 to rotate in the reverse direction.

To avoid biting of contracted driving spring 11 into a gap between driving shaft 9 and transmission shaft 10 that may cause damage to driving shaft 9 and transmission shaft 10 or malfunction of clutch device 7, cord pulley 4 includes a coaxial positioning axle 12 to which transmission shaft 10 is mounted. A positioning ring 14 is fixed by a screw 13 to an end face of positioning axle 12. A spacing B between the end face of positioning axle 12 and an end face of driving shaft 9 is slightly larger than a spacing C between the end face of driving shaft 9 and an end face of an axial hole 10*a* of transmission shaft 10 facing the end face of driving shaft 9. Due to provision of positioning axle 12 and positioning ring 14, transmission shaft 10 can rotate smoothly while assuring the gap between transmission shaft 10 and driving shaft 9 to be much smaller than the diameter of wire of the driving spring 11, avoiding biting of contracted driving spring 11 into the gap between driving shaft 9 and transmission shaft 10.

To allow easy assembly, transmission shaft 10 includes an inner transmission shaft 10*b* rotatably mounted to positioning axle 12 and an outer transmission shaft 10*c* coupled to inner transmission shaft 10*b*. Inner transmission shaft 10*b* includes axial hole 10*a* and a transmission ring 10*d*. Transmission ring 10*d* includes an insert end 10*e*. Outer transmission shaft 10*c* includes a connecting head 10*g* having a groove 10*f*. Insert end 10*e* is engaged in groove 10*f*. Outer transmission shaft 10*c* further includes a rotary head 10*h* extending out of chamber 8. Rotary head 10*h* is coupled to a drum driving shaft 17. Drum driving shaft 17 has a connecting block 16 coupled to drum 6.

To assure smooth driving of transmission shaft 10 by driving shaft 9 or to avoid sliding, driving spring 11 includes a coil portion having 2-5 coils in tight contact with the inner periphery of chamber 8. Thus, when driving shaft 9 rotates, sufficient friction exists between driving spring 11 and the inner periphery of chamber 8 to mate with driving shaft 9 for contracting or expanding the inner diameter of driving spring 11 while avoiding excessive friction between driving spring 11 and the inner periphery of chamber 8 causing difficulties in driving transmission shaft 10. The coil portion of driving spring 11 is rectangular in cross section to increase the contact friction. Preferably, the outer diameter of driving shaft 9 is larger than an inner diameter of the coil portion of driving spring 11 by 0.2-0.5 mm. Preferably, the coil portion of driving spring 11 has an outer diameter larger than an inner diameter of chamber 8 by 0.2-0.5 mm. Preferably, the outer diameter of inner transmission shaft 10*b* is smaller than the inner diameter of the coil portion of driving spring 11 by 0.1-0.3 mm.

A threaded tube 19 is rotatably mounted around drum driving shaft 17 in drum 6. Threaded tube 19 is coupled to housing 2 by engagement of a protrusion 24 on an end face of housing 2 and a groove 25 in an end face of threaded tube 19. A positioning block 20 is threadedly engaged with threaded tube 19 and has a protrusion 20*a*. Positioning block 20 is slideably received in drum 6 in an axial direction of drum 6. A rotary seat 21 is threadedly engaged with and adjacent to an end of threaded tube 19. A torsion spring 22 is mounted between rotary seat 21 and the end of threaded tube 19. A stop plate 23 is mounted to an inner side of rotary seat 21. Provision of threaded tube 19, positioning block 20, and stop plate 23 allows control of the folding/unfolding extent of the window shade. By utilizing torsion spring 22 between rotary seat 21 and the end of threaded tube 19 and by providing stop plate 23 on rotary seat 21, damage to positioning block 20 and stop plate 23 can be avoided while providing reliable and durable operation. Torsion spring 22 includes an intermediate coil portion 22*a* having a plurality of spaced coils. Thus, torsion spring 22 can be compressed when rotary seat 21 rotates towards torsion spring 22, allowing movement of rotary seat 21 along threading on threaded tube 19.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A drum driving device for a window shade comprising a housing fixed to a frame of the window shade, a cord pulley rotatably received in the housing and having a cord wound around the cord pulley, a drum rotatably mounted to a drum shaft received in the housing, and a single-direction clutch device mounted between the drum and the cord pulley, with the clutch device comprising:

a chamber defined in the housing and coaxial to an axis of the housing;

a driving shaft coaxially mounted to the cord pulley;

a transmission shaft mounted in the chamber, with the transmission shaft having an outer diameter slightly smaller than an outer diameter of the driving shaft; and a driving spring mounted to an inner periphery of the chamber and around the driving shaft and the transmission shaft in the chamber, with the driving spring being in tight contact with the driving shaft and the inner periphery of the chamber, and with the transmission shaft extended out of the chamber and connected to the drum, with the cord pulley including a coaxial positioning axle to which the transmission shaft is mounted, with the positioning axle including a positioning ring on an end face of the positioning axle, with a spacing between the end face of the positioning axle and an end face of the driving shaft being slightly larger than a spacing between the end face of the driving shaft and an end face of an axial hole of the transmission shaft facing the end face of the driving shaft, with the transmission shaft including an inner transmission shaft rotatably mounted to the positioning axle, with the transmission shaft further including an outer transmission shaft coupled to the inner transmission shaft, with the inner transmission shaft including the axial hole and a transmission ring, with the transmission ring including an insert end, with the outer transmission shaft including a connecting head having a groove, with the insert end engaged in the groove, with the outer transmission shaft further including a rotary head extending out of the chamber, with the rotary head coupled to a drum driving shaft, with the driving shaft having a connecting block coupled to the drum.

2. The drum driving device as claimed in claim 1, with the driving spring including a coil portion having 2-5 coils in tight contact with the inner periphery of the chamber.

3. The drum driving device as claimed in claim 2, with the coil portion of the driving spring being rectangular in cross section.

4. The drum driving device as claimed in claim 3, with the outer diameter of the driving shaft being larger than an inner diameter of the coil portion of the driving spring by 0.2-0.5 mm, with the coil portion of the driving spring having an outer diameter larger than an inner diameter of the chamber by 0.2-0.5 mm, with the outer diameter of the inner transmission shaft being smaller than the inner diameter of the coil portion of the driving spring by 0.1-0.3 mm.

5. A drum driving device for a window shade comprising a housing fixed to a frame of the window shade, a cord pulley rotatably received in the housing and having a cord wound around the cord pulley, a drum rotatably mounted to a drum shaft received in the housing, and a single-direction clutch device mounted between the drum and the cord pulley, with the clutch device further comprising:

a chamber defined in the housing and coaxial to an axis of the housing;

a driving shaft coaxially mounted to the cord pulley;

a transmission shaft mounted in the chamber, with the transmission shaft having an outer diameter not larger than an outer diameter of the driving shaft;

a driving spring mounted to an inner periphery of the chamber and around the driving shaft and the transmission shaft in the chamber, with the driving spring being in tight contact with the driving shaft and the inner periphery of the chamber, and with the transmission shaft extended out of the chamber and connected to the drum, and a drum driving shaft coupled between the drum and the transmission shaft, with a threaded tube rotatably mounted around the drum driving shaft and coupled to the housing, with a positioning block threadedly engaged with the threaded tube and having a protrusion, with the positioning block slideably received in the drum in an axial direction of the drum, with a rotary seat threadedly engaged with and adjacent to an end of the threaded tube, with a torsion spring mounted between the rotary seat and the end of the threaded tube, with a stop plate mounted to an inner side of the rotary seat.

6. The drum driving device as claimed in claim 5, with the torsion spring including an intermediate coil portion having a plurality of spaced coils.

* * * * *